US005438904A

United States Patent [19]

Uozumi

[11] Patent Number: 5,438,904

[45] Date of Patent: Aug. 8, 1995

[54] BRAID STRUCTURE BODY

[75] Inventor: Tadashi Uozumi, Kyoto, Japan

[73] Assignee: Murata Kikai Kabushiki Kaisha, Kyoto, Japan

[21] Appl. No.: 186,150

[22] Filed: Jan. 25, 1994

[30] Foreign Application Priority Data

Feb. 8, 1993 [JP] Japan ..... 5-019753

[51] Int. Cl.[6] ..... D04C 1/06

[52] U.S. Cl. ..... 87/1; 87/6

[58] Field of Search ..... 87/1, 5, 6, 7, 8, 9, 87/11, 33

[56] References Cited

U.S. PATENT DOCUMENTS

| | | | |
|---|---|---|---|
| 450,684 | 4/1891 | Struss | 87/7 X |
| 450,685 | 4/1891 | Struss | 87/7 |
| 458,644 | 9/1891 | Struss | 87/7 X |
| 1,891,211 | 12/1932 | Blaisdell | 87/6 |
| 2,879,687 | 3/1959 | Leimbach et al. | 87/11 X |
| 4,719,837 | 1/1988 | McConnell et al. | 87/11 X |
| 5,108,810 | 4/1992 | Williams | 87/9 |
| 5,287,790 | 2/1994 | Akiyama et al. | 87/9 |

FOREIGN PATENT DOCUMENTS

| | | | |
|---|---|---|---|
| 1202000 | 8/1970 | United Kingdom | 87/8 |
| 1103 | 1/1992 | WIPO | 87/33 |

*Primary Examiner*—Joseph J. Hail, III

*Attorney, Agent, or Firm*—Armstrong, Westerman, Hattori, McLeland & Naughton

[57] ABSTRACT

A braid structure body constituted from a tubular portion composed of side walls surrounding a hollow or a combination of such tubular portions. Intermediate walls are disposed in the tubular portion composed of side walls to maintain the three-dimentional shape of the braid structure body and to increase the rigidity and the strength.

6 Claims, 9 Drawing Sheets

C
8
s
3
3'
6
b
7
5
10
9
15
12
13
17
11
14
16'
17
16
y
e
y
e
y
e
y
e
y

BRAID STRUCTURE BODY

BACKGROUND OF THE INVENTION

1. Field of the Invention

This invention relates to a braid structure body braided by crossing a plurality of yarns or fiber bundles with each other and having a section of any of various shapes.

2. Prior Art

Conventionally, as a braid whose sectional shape has a three-dimensional structure such as an H-shape, a T-shape or the like, those braids wherein side walls which form a sectional shape of an H-shape, a T-shape or the like are braided in a braid structure or those braids composed of a plurality of such braid structures overlapped with each other so as to have a great thickness are known.

A braid wherein side walls forming a sectional shape of an H-shape, a T-shape or a like shape are braided in a braid structure is difficult to maintain its sectional shape such as an H-shape or a T-shape since the side walls thereof are thin, and the application field of it is restricted since it does not have a sufficient rigidity or strength.

Meanwhile, another braid whose sectional shape has a three-dimensional shape such as an H-shape or a T-shape and which is constituted in a three-dimensional woven fabric structure in order to improve the rigidity and the strength requires a longer time to manufacture it, resulting in deterioration of the productivity, and besides, since the amount of yarns or fiber bundles to be used is increased, the weight of the braid itself is increased and the braid becomes expensive. Further, when it is tried to impregnate the braid with a resin or a like substance, it is difficult to impregnate the resin or the like substance into the inside of the braid. The conventional braids have such problems as described above.

BRIEF SUMMARY OF THE INVENTION

It is an object of the present invention to provide a braid structure body which presents a cubic effect and has a sufficient rigidity and strength solving the subject of braids whose sectional shapes have a three-dimensional structure such as an H-shape or a T-shape described above.

In order to attain the object described above, according to the present invention, a braid structure body is constituted from a tubular portion composed of side walls surrounding a hollow or a combination of such tubular portions.

In the tubular portion composed of side walls, intermediate walls may be disposed to maintain the three-dimentional shape of the braid structure body and to increase the rigidity and the strength.

Furthermore, reinforcing members are disposed along opposing ones of the intermediate walls of the tubular portions and those of the side walls opposing to the intermediate walls.

BRIEF DESCRIPTION OF THE DRAWINGS

FIG. 2 is an enlarged side elevational view, partly in section, of a bobbin carrier driving section, a guide member or the like;

DETAILED DESCRIPTION OF PREFERRED EMBODIMENTS

While embodiments of the present invention are described below, the present invention is not limited to the present embodiments at all unless any modification does not depart from the spirit and scope of the invention.

Before a braid structure body of the present invention is described, an example of an apparatus for braiding the braid structure body of the present invention will be described in outline with reference to FIGS. 1 and 2.

Figure 1:
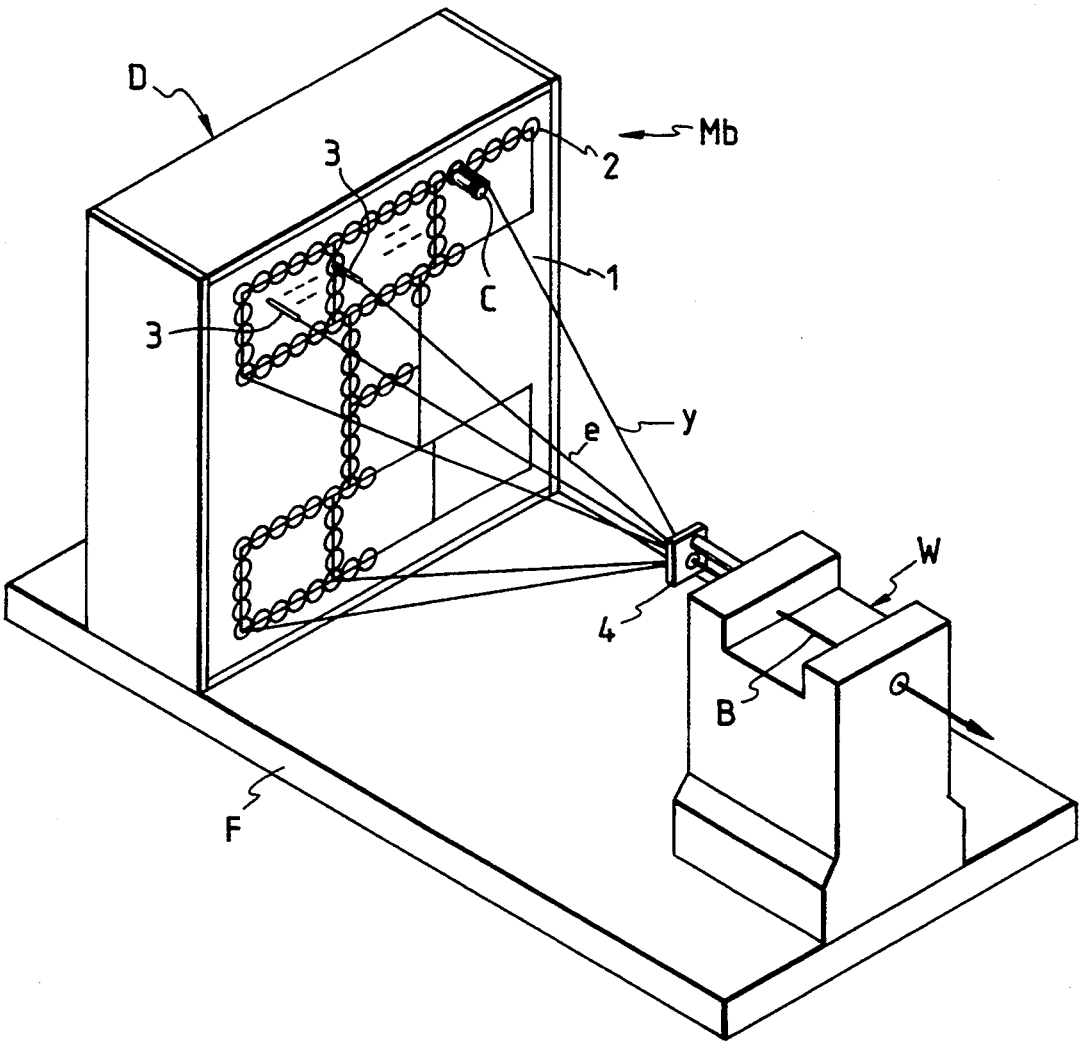
FIG. 1 is a schematic perspective view of a braiding apparatus for braiding a braid structure body of an H-shaped cross section.

FIG. 1 is a schematic perspective view of a braiding apparatus Mb for braiding a braid structure body B having an H-shaped cross section, and the braiding apparatus Mb is constituted principally from a bobbin carrier driving section D located on a pedestal F and a braid structure body accommodation section W for receiving and taking up or accommodating a braided braid structure body B.

Referring to FIG. 1, reference numeral 1 denotes a front plate disposed substantially vertically on the pedestal F, and a track 2 is perforated in the front plate 1. In the embodiment shown in FIG. 1, since the sectional shape of the braid structure body B to be braided is an H-shape, the track 2 is formed in a generally H-shaped configuration.

Reference character C denotes a bobbin carrier (in FIG. 1, only one bobbin carrier C is illustratively shown) which travels along the track 2, and a large number of bobbin carriers C are caused to travel along the track 2 to cross yarns or fiber bundles (hereinafter referred to merely as "yarns") y or the like, from which the braid structure body B is to be formed, with each other to braid the braid structure body B. Further, reference character 3 denotes a guide member for a reinforcing member e such as a yarn, a string, a wire, a bar-formed member, a fiber bundle or the like which will be hereinafter described.

Reference numeral 4 denotes a ferrule located at the braid structure body accommodation section W for converging the yarns y to form a braiding point, and the braid structure body B converged and braided by the ferrule 4 is either taken up by a take-up apparatus not shown or accommodated into an accommodation box or a like member or else cut into segments of a suitable length and accommodated into an accommodation box or a like member. Further, it is also possible to subsequently perform processing for a next step such as resin processing.

Figure 2:
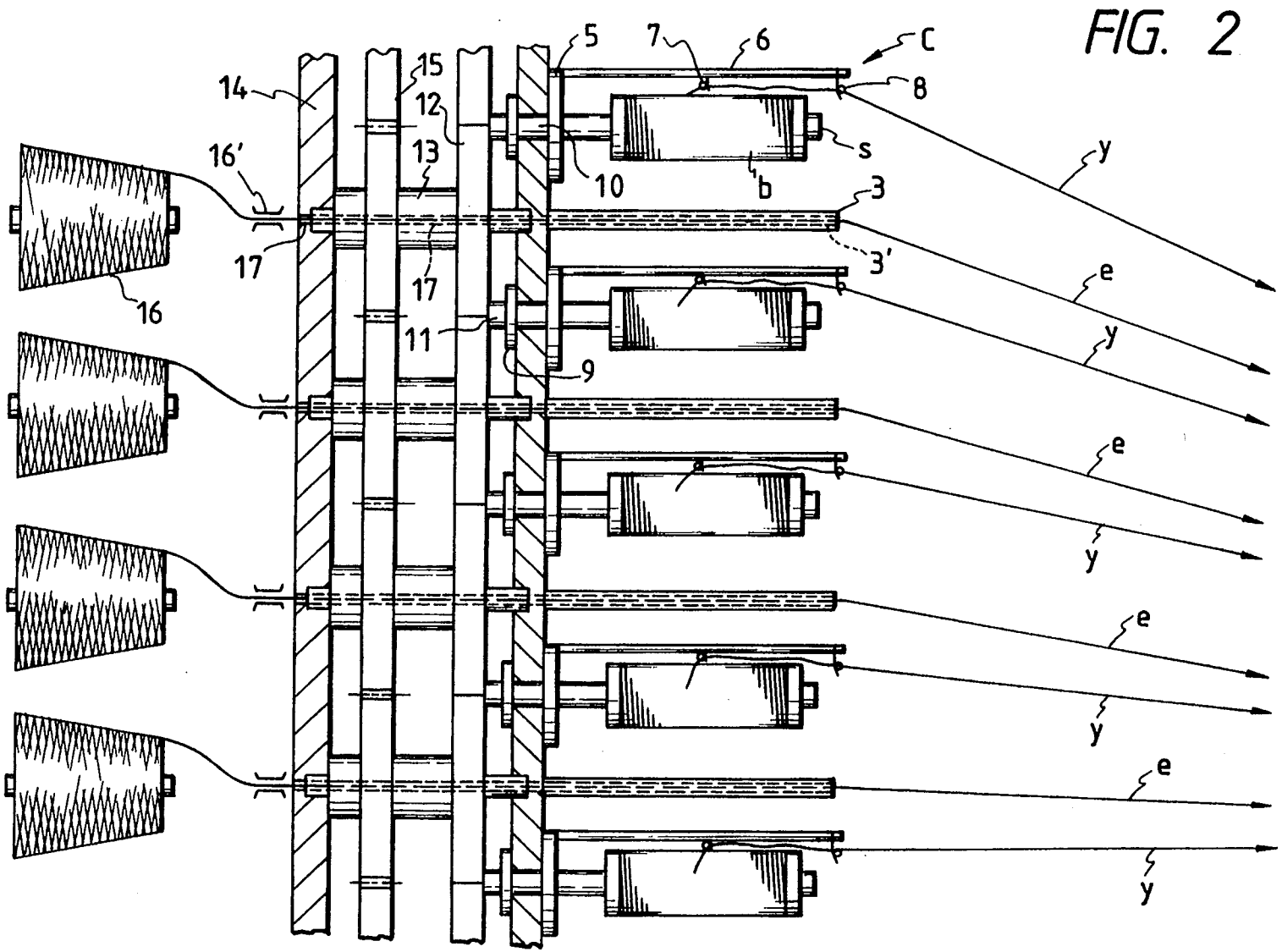

FIG. 2 is an enlarged side elevational view, partly in section, of the bobbin carrier driving section D, the guide member 3 or the like. Referring to FIG. 2, a yarn y wound on a bobbin b fitted for rotation on a spindle s located perpendicularly on an outer flange 5 of each bobbin carrier C is drawn by way of a yarn guide 7, which is mounted for movement along a support post 6 located perpendicularly on the outer flange 5 substantially in parallel to the spindle s, and a fixed yarn guide 8 disposed at an end portion of the support post 6.

Reference numeral 9 denotes an inner flange, and the front plate 1 is held between the outer flange 5 and the inner flange 9 to hold the bobbin carriers C in a substantially horizontal condition. Reference numeral 10 denotes a guide portion fitted in the track 2 perforated in the front plate 1 for guiding the bobbin carrier C to travel along the track 2, and reference numeral 11 denotes an engaging shaft of each bobbin carrier C for engaging a recess of a vane wheel 12 which has the recess at a suitable position of a circumference thereof. The engaging shaft 11 is located perpendicularly on the inner flange 9 remotely from the guide portion 10.

Reference numeral 13 denotes a rotary shaft mounted for rotation between the front plate 1 and a back plate 14, and the vane wheel 12 is securely mounted on the corresponding rotary shaft 13 while a gear 15 is securely mounted on the rotary shaft 13. The gears 15 are disposed such that adjacent ones of them are held in meshing engagement with each other, and also the vane wheels 12 are disposed such that adjacent ones of them are substantially in contact with each other. When the gears 15 are driven to rotate by suitable driving means not shown, also the vane wheels 12 securely mounted on the rotary shafts 13 are rotated, and as the vane wheels 12 rotate, the engaging shafts 11 of the bobbin carriers C engaged in the recesses of the vane wheels 12 are moved so that the bobbin carriers C travel along the track 2. In this manner, a large number of such bobbin carriers C are driven to travel along the track 2 by the bobbin carrier driving section D to cross the yarns y drawn out from the bobbins b placed on the bobbin carriers C with each other to braid the braid structure body B.

Reference numeral 16 denotes a bobbin on which a reinforcing member e is wound, and the reinforcing members e drawn out from the bobbins 16 advance toward the ferrule 4 through perforations 17 perforated in the back plate 14, the rotary shafts 13 and the front plate 1 and perforations 3' of the guide members 3 located perpendicularly on the front plate 1, and are incorporated into the yarns y crossed with each other by the bobbin carriers C travelling along the track 2 to construct the braid structure body B. Also it is possible to accommodate the reinforcing members e in a can or a like vessel without taking up them onto the bobbins 16, and where the reinforcing members e are comparatively hard, it is also possible to cut them into segments of a suitable length and place them substantially horizontally on a support table. It is to be noted that reference character 16' denotes a tension washer for adjusting the tension of a yarn y drawn out from a bobbin 16, and the tension washer 16' is installed in accordance with the necessity. Naturally, such tension adjusting member is not limited to the tension washer 16', and various members may be used for the tension adjusting member.

As described above, while the engaging shafts 11 of the bobbin carriers C are held in the recesses of adjacent ones of the vane wheels 12, the gears 15 are rotated by the suitable driving means to rotate the vane wheels 12 to cause the bobbin carriers C to travel suitably along the track 2 to cross the yarns y or the reinforcing members e with each other to braid the braid structure body B.

Subsequently, the braid structure body B of the present invention will be described with reference to FIGS. 3 and 4.

Figure 3:
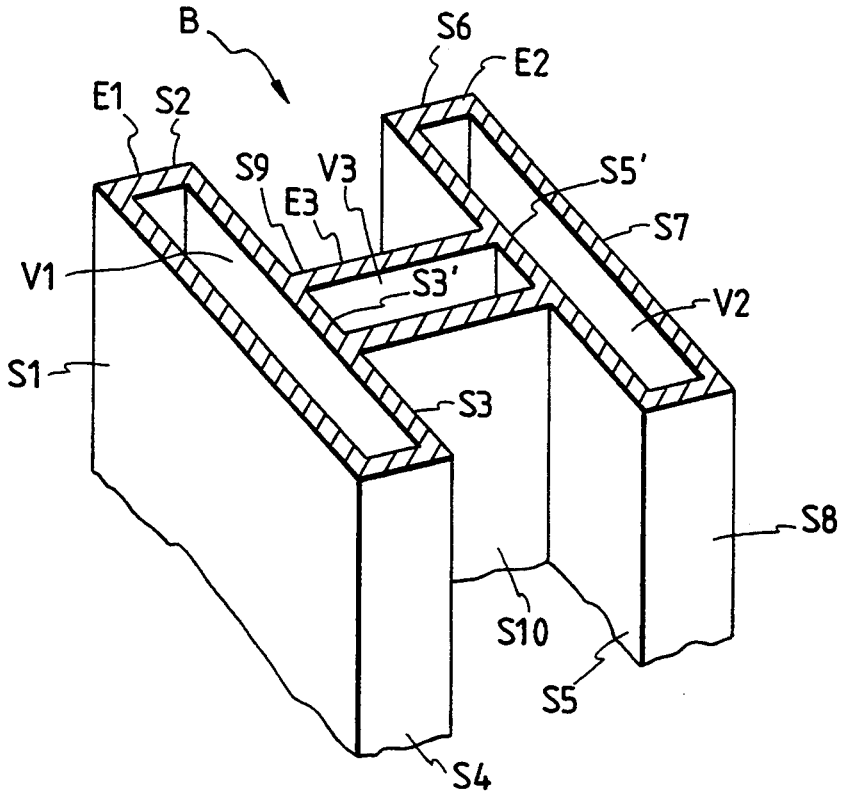
FIG. 3 is a perspective view showing an embodiment of a braid structure body of the present invention.

FIG. 3 is a perspective view showing an embodiment of the braid structure body B of the present invention, and the braid structure body B having an H-shaped cross section is shown. The braid structure body B having an H-shaped cross section is constituted from a pair of tubular portions E1 and E2 (when a common tubular portion is to be referred to, it is referred to merely as "tubular portion E") of a cross section of a substantially rectangular shape having hollows V1 and V2 (when a common hollow is to be referred to, it is referred to merely as "hollow V") disposed substantially in parallel to each other, and a further tubular portion E3 of a similar section of a substantially rectangular shape connecting substantially central portions of the tubular portions E1 and E2 to each other and having a hollow V3. And, the tubular portion E1 is formed from four side walls S1, S2, S3 and S4 (when a common side wall is to be referred to, it is referred to merely as "side wall S") braided in a braid structure, and the tubular portion E2 is formed from side walls S5, S6, S7 and S8 braided similarly in a braid structure while also the tubular portion E3 is formed from portions S3' and S5' of the side walls S3 and S5 described above and side walls S9 and S10 braided in a braid structure. It is to be noted that it is also possible to omit the side walls S3' and S5' of the tubular portion E3 so that the hollows V1 and V2 and the hollow V3 are interconnected without separating them.

Since the braid structure body B is formed from a tubular portion E composed of side walls S surrounding a hollow V or a suitable combination of such tubular portions E as described above, different from braids having a section of an H-shape, a T-shape or a like shape and formed from walls braided in a conventional braid structure, it is easy to maintain the three-dimensional shape of the braid structure body B, and the braid structure body B which is high in rigidity and strength and has a great volume can be constructed.

Further, since the braid structure body B has the hollows V, a resin can be impregnated into the braid structure body B from the inner side, and consequently, penetration of a resin can be performed into the inside of the braid structure body B and the time for impregnation of a resin is reduced. Accordingly, enhancement of the productivity can be achieved. By impregnating a resin into the braid structure body B and shaping the braid structure body B in this manner, the rigidity and the strength of the braid structure body B can be enhanced and the braid structure body B can be shaped into a shape of a higher degree of accuracy. Further, by deforming the braid structure body B into a desired shape and then hardening the resin impregnated in the braid structure body B, the braid structure body B can be shaped into a desired shape.

Figure 4:
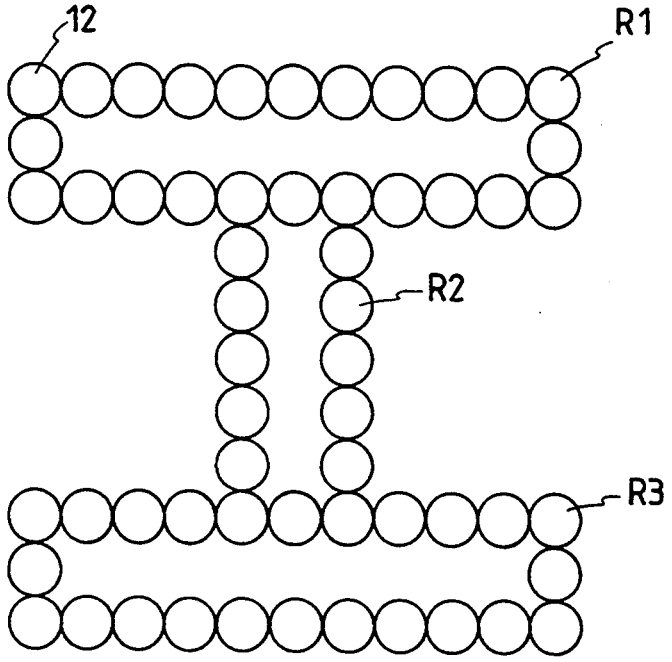
FIG. 4 is a view showing an arrangement of such vane wheels for braiding a braid structure body of an H-shaped cross section as shown in FIG. 3.

FIG. 4 is a view showing an arrangement of the vane wheels 12 (the recesses formed on the vane wheels 12 are omitted) for braiding the braid structure body B having such an H-shaped cross section as shown in FIG. 3, and such a braid structure body B as shown in FIG. 3 is braided by causing the bobbin carriers C to travel along rectangular tracks R1, R2 and R3 formed by the vane wheels 12 by means of such a bobbin carrier driving section D as shown in FIG. 2. It is to be noted that the braid structure body B of an H-shaped cross section shown in FIG. 3 is braided only with the yarns y drawn out from the bobbins b placed on the bobbin carriers C and does not use the reinforcing members e.

Figure 5:
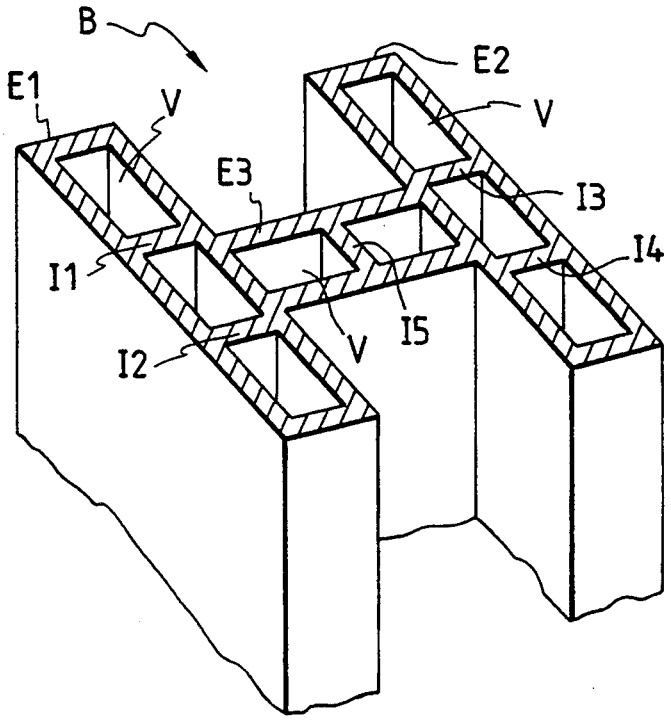
FIG. 5 is a perspective view showing another embodiment of a braid structure body of the present invention.

FIG. 5 is a perspective view showing another embodiment of the braid structure body B of the present invention, and the braid structure body B of an H-shaped cross section is shown.

The braid structure body B of an H-shaped cross section shown in FIG. 5 is constructed such that intermediate walls I1, I2, I3, I4 and I5 (when a common intermediate wall is to be referred to, it is referred to merely as "intermediate wall I") formed in a braid structure are disposed in the tubular portions E1 and E2 and the tubular portion E3, respectively, of the braid structure body B of an H-shaped cross section shown in FIG. 3. Where such intermediate walls I are disposed, it becomes further easy to maintain the three-dimensional shape of the braid structure body B and to further increase the rigidity and the strength.

Figure 6:
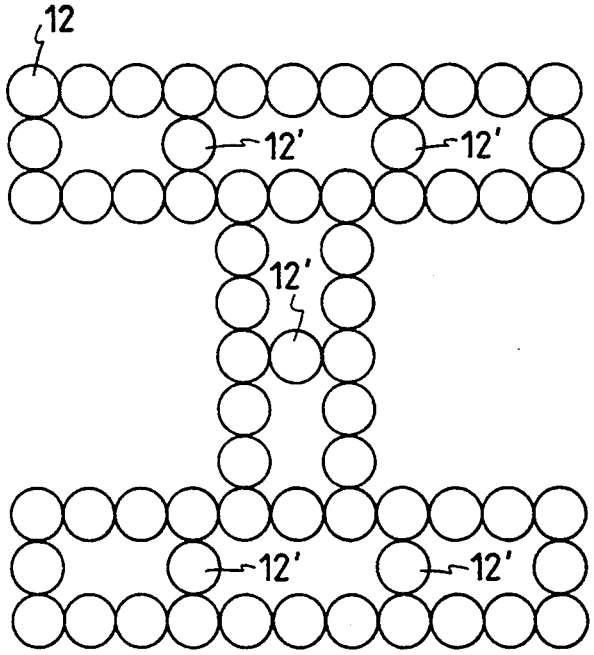
FIG. 6 is a view showing an arrangement of such vane wheels for braiding a braid structure body of an H-shaped cross section as shown in FIG. 5.

FIG. 6 is a view showing an arrangement of the vane wheels 12 for braiding the braid structure body B of an H-shaped cross section having such intermediate walls I as shown in FIG. 5, and bridging vane wheels 12' for braiding the intermediate walls I are disposed suitably between rows of the vane wheels 12.

Figure 12:
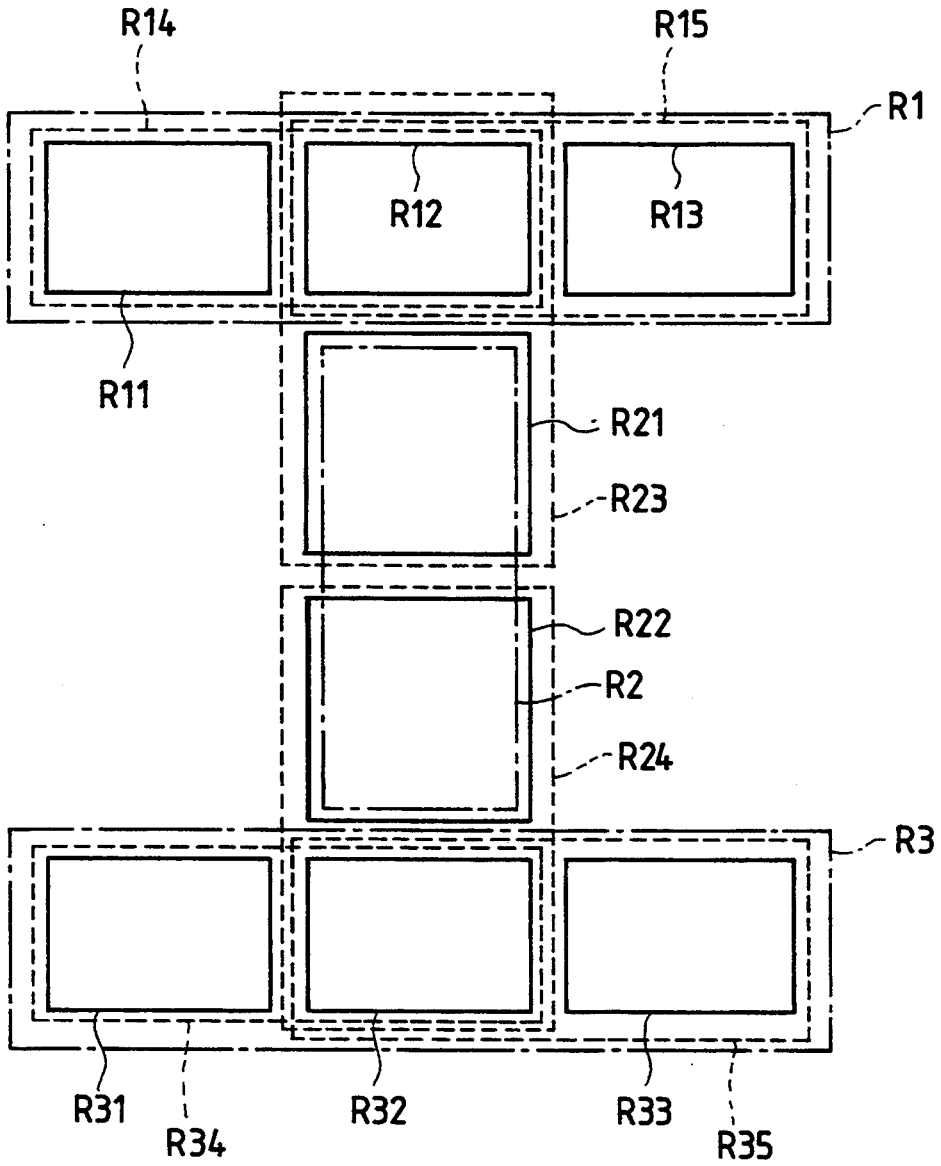
FIG. 12 is a schematic illustration showing an embodiment of tracks of a bobbin carrier in the arrangement of vane wheels of FIG. 6.
Figure 13:
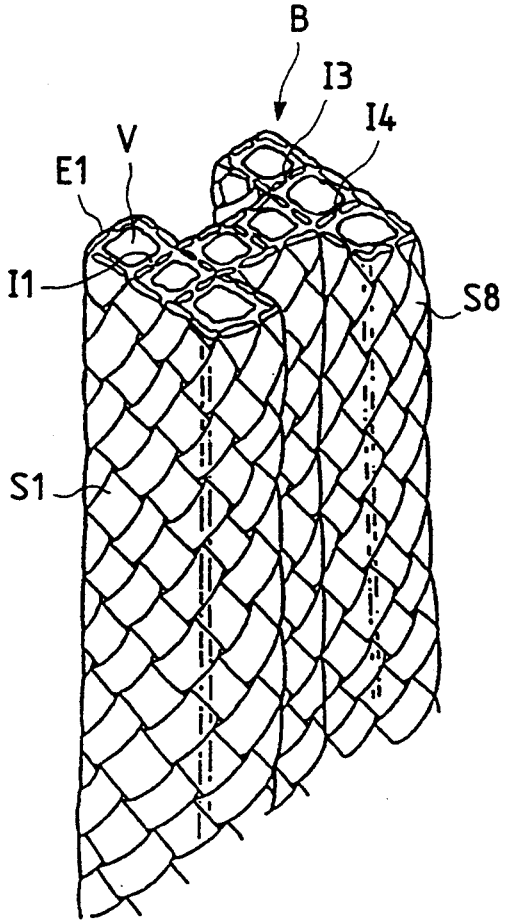
FIG. 13 is a perspective view showing structural condition of a braid structure body of FIG. 5.
Figure 14:
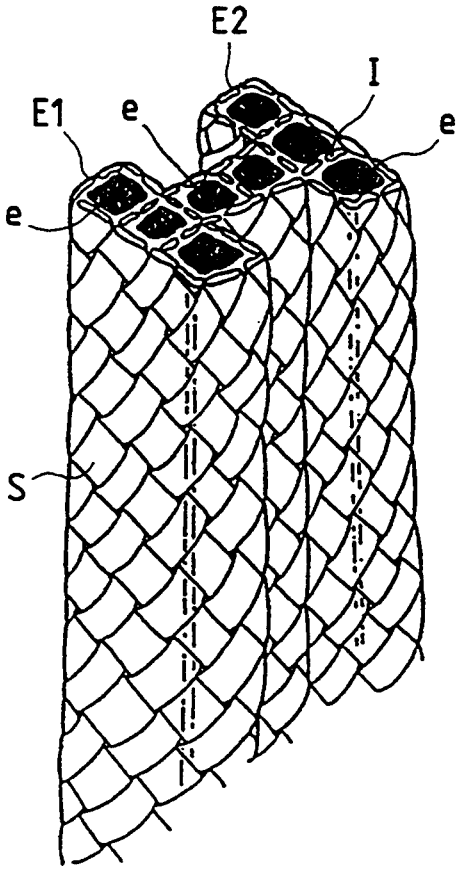
FIG. 14 is a perspective view showing structural condition of a braid structure body of FIG. 9.

FIG. 12 shows one embodiment of tracks of bobbin carrier which are constituted in an arrangement of the vane wheels shown in FIG. 6. The tracks R11, R12, R13, R21, R22, R31, R32 and R33 are the smallest unit of tracks. The braid structure body of an H-shaped cross section shown in FIG. 5 may be constructed only by these tracks. However, to increase the strength of the structure body, it is possible to further provide a track R14 which extends from the track R11 to the track R12 and on which a carrier travels, a track R15 which extends from the track R12 to the track R13 and on which a carrier travels, a track R23 which extends from the track R21 to the track R12 and on which a carrier travels, a track R24 which extends from the track R22 to the track R32 and on which a carrier travels, a track R34 which extends from the track R31 to the track R32 and on which a carrier travels, and a track R35 which extends from the track R32 to the track R33 and on which a carrier travels.

Furthermore, it may be possible to provide a track R1 which extends over the tracks R11, R12 and R13 and on which a carrier travels, a track R2 which extends from the track R21 to the track R22 and on which a carrier travels, and a track R3 which extends over the tracks R31, R32 and R33 and on which a carrier travels. A braid structure body having great strength can be constructed by moving carriers along the smallest unit of tracks as mentioned above.

Figure 7:
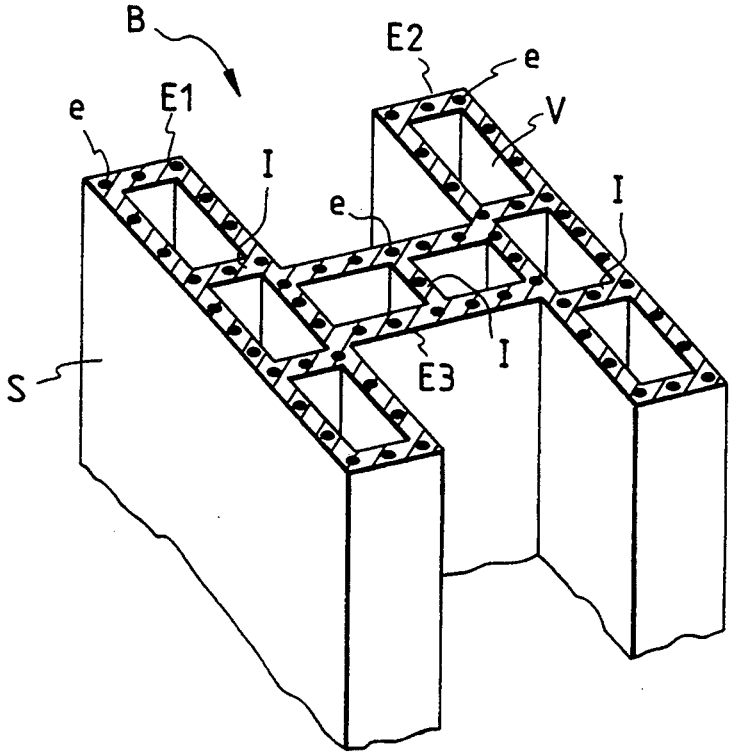
FIG. 7 is a perspective view showing a further embodiment of a braid structure body of the present invention.

FIG. 7 is a perspective view showing a further embodiment of the braid structure body B of the present invention, and the braid structure body B of the present embodiment is constructed such that reinforcing members e indicated by dark circles (•) are inserted in the side walls S and the intermediate walls I of the braid structure body B of an H-shaped cross section shown in FIG. 5. By supplying the reinforcing members e from the bobbins 16 by way of the perforations 17 perforated in the back plate 14, the rotary shafts 13 on which the vane wheels 12 are securely mounted and the front plate 1 and the perforations 3' of the guide members 3 located perpendicularly on the front plate 1 as shown in FIG. 2, the reinforcing members e can be arranged into the insides of the side walls S and the intermediate walls I of the braid structure body B.

Figure 8:
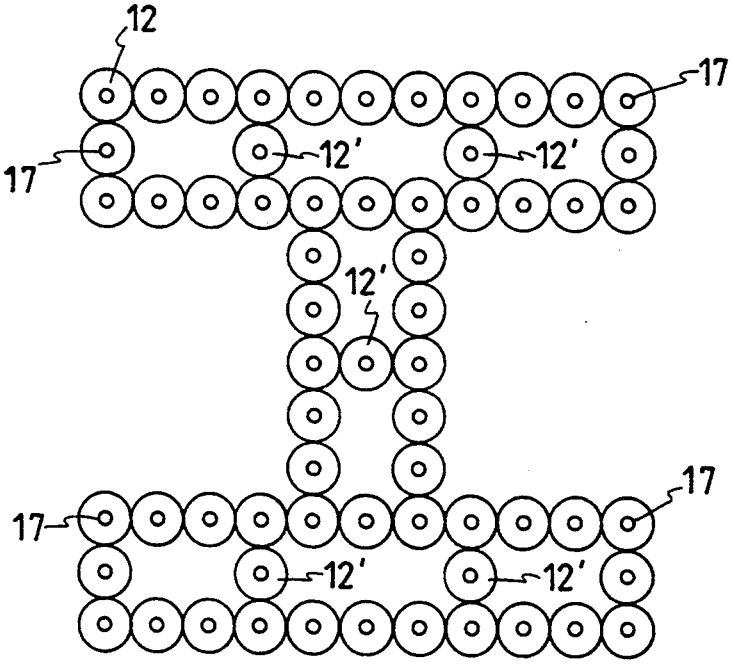
FIG. 8 is a view showing an arrangement of such vane wheels for braiding a braid structure body of an H-shaped cross section as shown in FIG. 7.

FIG. 8 is a view showing an arrangement of the vane wheels 12 for braiding the braid structure body B of an H-shaped cross section wherein the reinforcing members e are arranged in the insides of such side walls S and intermediate walls I as shown in FIG. 7, and the bridging vane wheels 12' for braiding the intermediate walls I are disposed between rows of the vane wheels 12 while the reinforcing members e are supplied from the perforations 17 formed in the predetermined vane wheels 12 and bridging vane wheels 12'.

By disposing the reinforcing members e along the longitudinal direction of the braid structure body B in the insides of the side walls S and the intermediate walls I of the braid structure body B as shown in FIG. 7, the flexural rigidity of the braid structure body B can be increased and also the strength of the braid structure body B is increased. Further, by removing the reinforcing members e to provide elongated holes after the braid structure body B is braided, it can be facilitated to impregnate a resin into the braid structure body B together with the hollows V of the braid structure body B described above. Further, using, as the reinforcing members e, the reinforcing members e which can be dissolved into a suitable solvent, the reinforcing members e can be dissolved by means of a solvent after the braid structure body B is braided to provide such elongated holes as described above. It is to be noted that the locations of the reinforcing members e disposed in the insides of the side walls S and the intermediate walls I are not limited to those shown in FIG. 7 at all, and they can be disposed suitably in accordance with the necessity.

Figure 9:
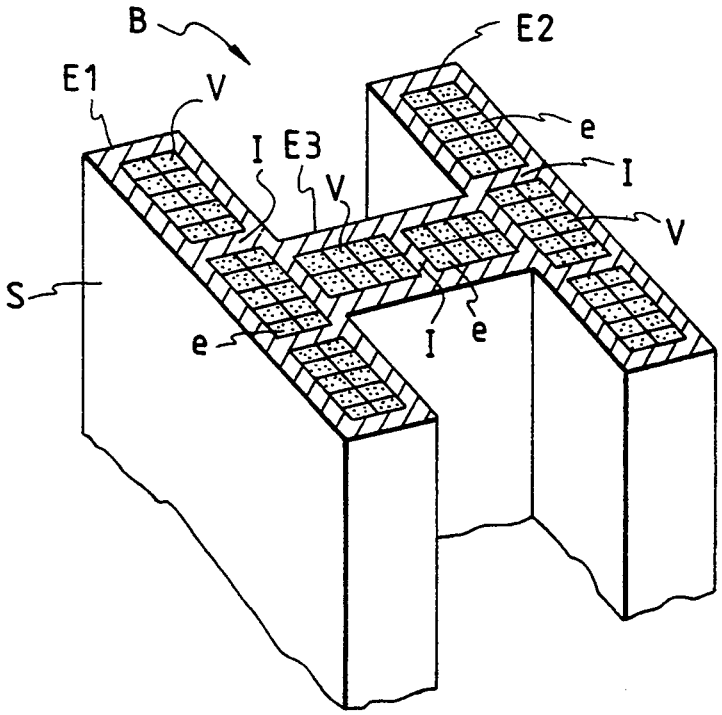
FIG. 9 is a perspective view showing a still further embodiment of a braid structure body of the present invention.

FIG. 9 is a perspective view showing a still further embodiment of the braid structure body B of the present invention, and the reinforcing members e, or a filler such as fiber bundles, foamed members such as foamed urethane members, or synthetic resin fillers are suitably inserted in the hollows V of the braid structure body B of an H-shaped cross section shown in FIG. 5.

Figure 10:
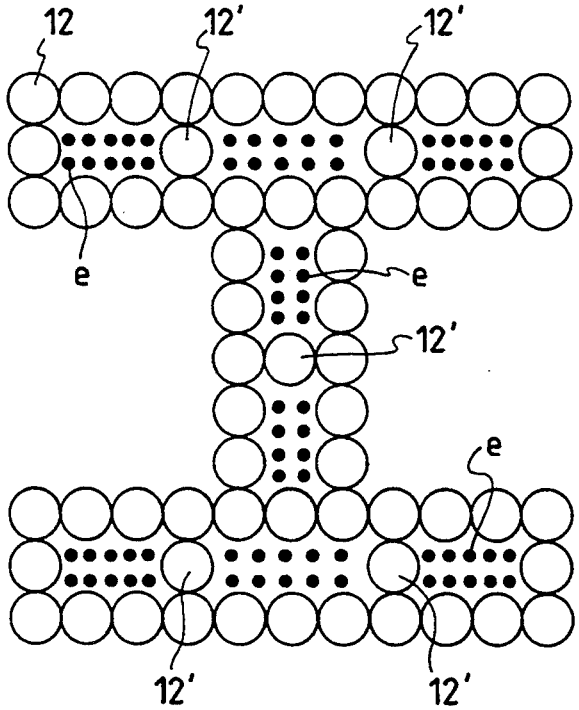
FIG. 10 is a view showing an arrangement of such vane wheels and so forth for braiding a braid structure body of an H-shaped cross section as shown in FIG. 9.

FIG. 10 is a view showing an arrangement of the vane wheels 12 for braiding such a braid structure body B of an H-shaped cross section wherein the reinforcing members e or a filler is inserted suitably in the hollows V as shown in FIG. 9, and different from the construction wherein the reinforcing members e are supplied from the perforations 17 formed in the vane wheels 12 and the bridging vane wheels 12' shown in FIGS. 2 and 8, the reinforcing members e or the like to be inserted into the hollows V are supplied by way of the perforations 3' of the guide members 3 which are suitably located perpendicularly on the front plate 1 at locations corresponding to distances between the rows of adjacent ones of the vane wheels 12 as shown in FIG. 10 and have such perforations 3' as shown in FIG. 2 and are then crossed with the yarns y drawn out from the bobbin carriers C which travel along the track 2 to braid the braid structure body B of an H-shaped cross section wherein the reinforcing members e or the like are inserted in the hollows V.

By suitably inserting the reinforcing members e or the like into the hollows V of the braid structure body B in this manner, the rigidity and the strength of the braid structure body B can be further increased and the shape of the braid structure body B can be maintained with certainty. Further, by suitably pulling off some of the reinforcing members e or the like inserted in such hollows V of the braid structure body B as shown in FIG. 9, elongated holes can be formed along the longitudinal direction of the braid structure body B to facilitate impregnation of a resin into the inside of the braid structure body B.

Figure 11:
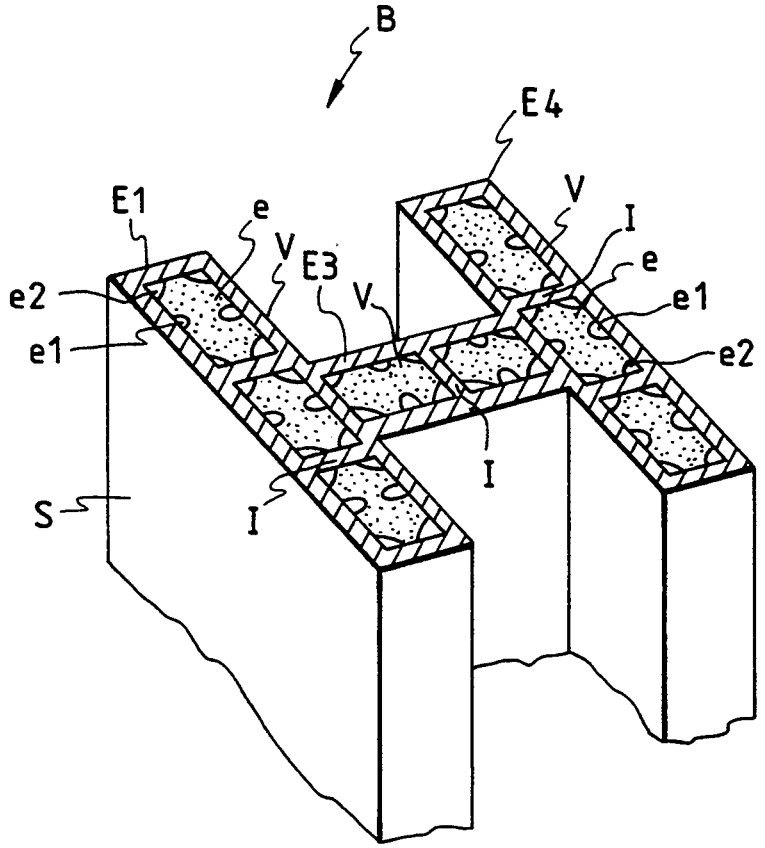
FIG. 11 is a perspective view showing a yet further embodiment of a braid structure body of the present invention.

FIG. 11 is a different embodiment of the braid structure body B of an H-shaped cross section wherein the reinforcing members e or a filler is inserted suitably in the hollows V of the braid structure body B shown in FIG. 9. Referring to FIG. 11, each of the reinforcing members e inserted in the hollows V has a suitable number of grooves e1 formed on an outer periphery thereof along the longitudinal direction thereof, and corner portions of each of the reinforcing members e is chamfered along the longitudinal direction of the reinforcing member e such that an elongated hole e2 may be formed along the longitudinal direction of the braid structure body B at each of corner portions adjacent the hollows V of the braid structure body B.

If a resin is impregnated into the braid structure body B after the reinforcing members e having such a shape as described above are inserted to braid the braid structure body B, then the resin can penetrate readily into the inside of the braid structure body B along the grooves e1 formed along the longitudinal direction of the reinforcing members e, or the elongated holes e2 formed at the corner portions adjacent the hollows V of the braid structure body B and adhesion between the braid structure body B and the reinforcing members e can be further made firm, and accordingly, the rigidity and the strength of the braid structure body B can be further increased.

Further, it is also possible to braid, when such a braid structure body B as shown in FIG. 5 is to be braided, the braid structure body B inserting braid cores, which can be removed after braiding, into the hollows V, insert the reinforcing members e described above into the hollows V formed by removing the braid cores after braiding and impregnate a resin into the braid structure body B.

While the present invention is described by way of an example of the braid structure bodies B of an H-shaped cross section as described above, not only the braid structure body B can be constructed with various cross sectional shapes but also the cross sectional shape of the hollows V or the tube upper portions E is not limited to a rectangular shape but may be various shapes including a circular shape or an elliptic shape.

Further, it is also possible to form the side walls S or the intermediate walls I of the braid structure body B in a multiple braid structure to increase the rigidity and the strength of the braid structure body B or maintain the braid structure body B in a further stabilized shape.

Further, it is also possible to construct the braid structure body B by suitably combining both of the construction wherein the reinforcing members e are disposed along the longitudinal direction of the braid structure body B in the insides of the side walls S and the intermediate walls I of such a braid structure body B as shown in FIG. 7 and the construction wherein the reinforcing members e or a filler is inserted suitably in such hollows V as shown in FIG. 9.

Furthermore, by causing fibers of a thermoplastic resin to be contained in the yarns y constituting the braid structure body B and treating the braid structure body B after braiding by head treatment to melt the thermoplastic resin fibers to partially couple the braid structure body B, the braid structure body B which is high in rigidity and strength and has a stabilized shape can be formed. Further, a similar effect can be obtained where thermosetting resin fibers are contained in place of thermoplastic resin fibers.

In the following, actions and effects of the embodiments of the present invention described above will be described.

Since the braid structure body B is constructed from a tubular portion E composed of the side walls S surrounding the hollow V or a suitable combination of such tubular portions E, the three-dimensional shape of the braid structure body B can be maintained readily, and the braid structure body B which is high in rigidity and strength and besides have a great volume can be constructed.

Since the hollows V are formed in the braid structure body B, the used amount of the yarns y constituting the braid structure body B is small, and the weight of the braid structure body B can be reduced and the braid structure body B can be manufactured at a low cost.

Since the braid structure body B has a hollow V, a resin can be impregnated into the braid structure body B from the inner side, and consequently, penetration of the resin can be performed to the inside of the braid structure body B and the time for impregnation of the resin is reduced. Accordingly, enhancement of the productivity can be achieved. By impregnating a resin into the braid structure body B and shaping the braid structure body B in this manner, the rigidity and the strength of the braid structure body B can be improved and the braid structure body B can be shaped in a shape of a higher degree of accuracy. Further, it is also possible to shape the braid structure body B into another desired shape.

By suitably providing an intermediate wall I in the braid structure body B formed from a tubular portion E composed of side walls S surrounding a hollow V or a suitable combination of such tubular portions E, it becomes easy to maintain the three-dimensional shape of the braid structure body B, and the rigidity and the strength can be further increased.

By disposing the reinforcing members e in the insides of the side walls S and the intermediate wall I of the braid structure body B, the flexural rigidity of the braid structure body B can be increased and the strength of the braid structure body B can be increased. Further, by pulling off the reinforcing members e to provide elongated holes after the braid structure body B is braided, impregnation of a resin into the braid structure body B can be facilitated. Further, it is possible, using, as the reinforcing members e, the reinforcing members e which can be dissolved into a suitable solvent, to dissolve the reinforcing members e by means of a solvent after the braid structure body B is braided to provide such elongated holes as described above.

By suitably inserting the reinforcing members e or the like into a hollow V of the braid structure body B, the rigidity and the strength of the braid structure body B can be further increased and the shape of the braid structure body B can be maintained with certainty. Further, by suitably pulling off some of the reinforcing members e or the like inserted in the hollow V, elongated holes can be formed along the longitudinal direction of the braid structure body B to facilitate impregnation of a resin into the inside of the braid structure body B.

By inserting the reinforcing members e, which have the grooves e1 formed on the outer peripheries thereof along the longitudinal direction, into the hollows V of the braid structure body B or by chamfering the corner portions of the reinforcing members e such that the elongated holes e2 may be formed at the corner portions adjacent the hollows V of the braid structure body B along the longitudinal direction of the braid structure body B, a resin can be penetrated readily into the inside of the braid structure body B along the grooves e1 provided along the longitudinal direction of the reinforcing members e or the elongated holes e2 provided at the corner portions adjacent the hollows V of the braid structure body B, and adhesion between the braid structure body B and the reinforcing members e can be made further firm. Accordingly, the rigidity and the strength of the braid structure body B can be further increased.

Since the present invention is constructed in such a manner as described so far, such effects as described below are exhibited.

Since a braid structure body is constituted from a tubular portion composed of side walls surrounding a hollow or a suitable combination of such tubular portions, it is easy to maintain the three-dimensional shape of the braid structure body, and it is possible to construct a braid structure body which is high in rigidity and strength and besides has a great volume.

Since the braid structure body has a hollow, a resin can be impregnated into the braid structure body also from the inner side, and accordingly, penetration of the resin can be performed to the inside of the braid structure body and the time for impregnation of the resin is reduced. Consequently, enhancement of the productivity can be achieved.

Since a hollow is formed in the braid structure body, the used amount of yarns constituting the braid structure body is small, and the braid structure body can be reduced in weight and the braid structure body can be manufactured at a low cost.

What is claimed is:

1. A braid structure body constituted from at least one tubular portion composed of side walls surrounding a hollow, at least one intermediate wall disposed in said tubular portion, and reinforcing members disposed in said hollow, said reinforcing members inserted having a suitable number of grooves formed on an outer periphery thereof along the longitudinal direction thereof so that an elongated hole is formed along the longitudinal direction of the braid structure body.

2. A braid structure body according to claim 1, wherein said reinforcing member is arranged in the inside of the side wall and/or the intermediate wall.

3. A braid structure body according to claim 2, wherein an elongated hole is provided in the inside of the side wall and the intermediate wall by removing the reinforcing member from the inside of the side wall and the intermediate wall after the braid structure body is braided.

4. A braid structure body according to claim 3, wherein an elongated hole is provided in the inside of the side wall and the intermediate wall by removing the reinforcing member from the inside of the side wall and the intermediate wall, and a resin is impregnated into the elongated holes.

5. A braid structure body according to claim 1, wherein an elongated hole is provided between the reinforcing members inserted into the hollow by removing some of the reinforcing members after braiding.

6. A braided structure body according to claim 5, wherein a resin is impregnated into the elongated hole which is formed along the longitudinal direction of the braid structure body.

* * * * *